United States Patent [19]

Semar

[11] Patent Number: 4,745,973

[45] Date of Patent: May 24, 1988

[54] SELECTIVE RUNNING TOOL FOR WELLS

[76] Inventor: James E. Semar, Rte. 2, Box 247, New Iberia, La. 70560

[21] Appl. No.: 41,460

[22] Filed: Apr. 23, 1987

[51] Int. Cl.[4] ..... E21B 23/02

[52] U.S. Cl. ..... 166/217; 166/208; 166/237; 166/382

[58] Field of Search ..... 166/217, 162, 117, 208, 166/216, 237, 377, 378, 381, 382

[56] References Cited

U.S. PATENT DOCUMENTS

| | | | |
|---|---|---|---|
| 3,079,996 | 3/1963 | Tamplen | 166/237 |
| 3,207,222 | 9/1965 | Tamplen | 166/136 |
| 3,319,719 | 5/1967 | De Cuir | 166/217 |
| 3,378,080 | 4/1968 | Fredd | 166/381 |
| 3,430,699 | 3/1969 | De Cuir | 166/217 |
| 3,498,376 | 3/1970 | Sizer et al. | 166/382 |
| 3,507,329 | 4/1970 | Stone, Jr. | 166/217 |
| 3,863,715 | 2/1975 | Yonker | 166/217 |
| 4,295,528 | 10/1981 | Carmody | 166/217 |
| 4,437,522 | 3/1984 | Krause, Jr. et al. | 166/382 |

FOREIGN PATENT DOCUMENTS

| | | | |
|---|---|---|---|
| 2039310 | 8/1980 | United Kingdom | 166/217 |

*Primary Examiner*—Stephen J. Novosad
*Assistant Examiner*—Terry Lee Melius
*Attorney, Agent, or Firm*—Gunn, Lee & Jackson

[57] ABSTRACT

A downhole running tool for positioning and locking tool support mandrels within landing nipples of the production tubing string of a well. A housing is provided which forms an internal receptacle receiving upper and lower core sections forming an elongated core which is telescopically movable to collapsed and extended positions defined by spaced stops formed by the housing. A portion of the core extends from the housing for connection with a tool support mandrel. A collet type releasable retainer secures locking lugs of the housing in a substantially fixed position within the internal receptacle and is movable to a lug release position upon contact with the landing nipple during upward movement of the downhole running tool to thus permit spring urged movement of the core to force the mandrel from its retracted position to its locating position. Complete collapsing telescopic movement of the housing relative to the elongated core is cushioned by the core urging spring to protect the mandrel and its wall tool from excessive jarring. A shear pin is sheared by downward jarring action of the housing relative to the core to thus release the core for full collapsing telescoping movement within the internal receptacle. During such movement a second shear pin is sheared to provide positive indication that the tool support mandrel has been placed in its fully locked position. Full collapsing of the core also retracts locking lug members from locking position within the fishing neck of the mandrel and permits separation of the core from the mandrel upon shearing of a third shear pin.

18 Claims, 1 Drawing Sheet

SELECTIVE RUNNING TOOL FOR WELLS

FIELD OF THE INVENTION

This invention relates generally to the setting of flow controlling devices such as storm chokes, safety valves, plugs etc. and well casing and production tubing and more specifically concerns a selective running tool which is utilized to locate and set various well tools and following setting, to efficiently release from the well tools for retrieval from the well and for reuse.

BACKGROUND OF THE INVENTION

It is frequently necessary to set flow control apparatus such as storm chokes, safety valves, plugs, etc. in various conductors forming the production tubing string of a well. Installation of such devices in a well is typically accomplished by a mandrel which is a locking device used to secure the apparatus being installed to a selected lending nipple of the tubing string. A running tool is typically interconnected with the mandrel and lowered into the well bore by means of conventional wireline equipment or by other suitable means. Although the mandrel and running tool are frequently interrelated, the present invention is directed to a particular type of running tool which is easily assembled to a tool setting mandrel and offers various advantages over conventional running tools.

To provide for setting of various well equipment the well conductors are provided with one or more landing nipples which are typically spaced at intervals along the length of the conductor. The running tool must locate the landing nipples in order to achieve location of a mandrel in assembly with the landing nipple and then must insure that the tool supporting mandrel is properly positioned and locked to the landing nipple. It is desirable to provide a running tool which will efficiently locate landing nipples and which has no tendency to scar the landing nipple during location and setting of the mandrel.

In most cases running tools are of fairly complex nature and are difficult to disassemble, clean and reassemble. It is typically difficult to accomplish disassembly, cleaning and reassembly in the field. Because of the complexity of most running tools, once used, a significant period of time and extensive amount of labor is typically required to prepare them for reuse. It is desirable therefore to provide a running tool which is of simple nature and is reliable in use and which may be efficiently restored to usable condition under normal field conditions. It is also desirable to provide a running tool which may be simply and efficiently cleaned and restored to a set condition for reuse.

In many cases running tools for setting well equipment utilize dogs in order to locate and establish connection with landing nipples. Since dog devices have a tendency to bend and cause malfunctions as forces are applied thereto, it is desirable to provide a landing nipple location and connection system having internal lugs which effectively resist bending even under severe force application. It is also desirable to provide a running tool mechanism that achieves proper location and locking of tool mandrels within landing nipples by simple easily controlled movement of the running tool within the well tubing.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only a typical embodiment of this invention and are therefore not to be considered limiting of its scope, for the invention may admit to other equally effective embodiments.

In the drawings

FIG. 1 is a sectional view of a landing nipple assembly of conventional nature and showing a tool supporting mandrel located above the level of the landing nipple.

FIG. 2 is a sectional view of a nipple which is constructed in accordance with the features of the present invention and shown in its normal assembled condition prior to use.

FIG. 3 is a sectional view of the selective running tool of FIG. 2 showing the components thereof in position following shearing of its internal shear pins and with its upper and lower lugs retracted.

DETAILED DESCRIPTION OF PREFERRED EMBODIMENT

Figure 1:
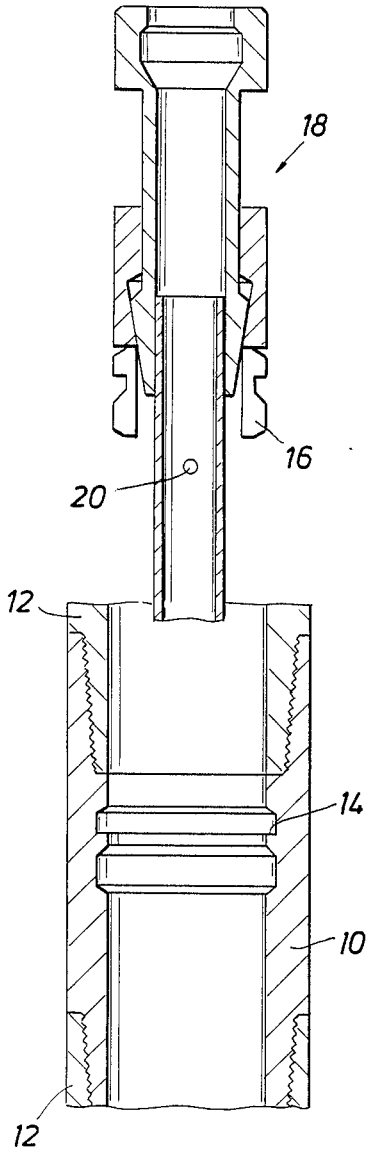

Referring now to the drawings and first to FIG. 1 a landing nipple 10 of conventional nature is threadedly interconnected within a tubing string 12 and defines an internal recess 14 within which the locking dogs 16 of a tool support mandrel 18 are located. The mandrel 18 is indicative only of one of a number of suitable mandrels which may be employed for supporting tools such as storm chokes, safety valves, plugs, etc. within the production tubing string of a well bore for production of petroleum products. The mandrel 18 defines a shear pin aperture 20 which establishes connection with a running tool by means of a shear pin. After the mandrel has been properly set and looked within the landing nipple the shear pin received in aperture 20 is sheared by an upward jarring force applied through the running tool to achieve disconnection of the running tool from the set and locked mandrel.

Figure 2:
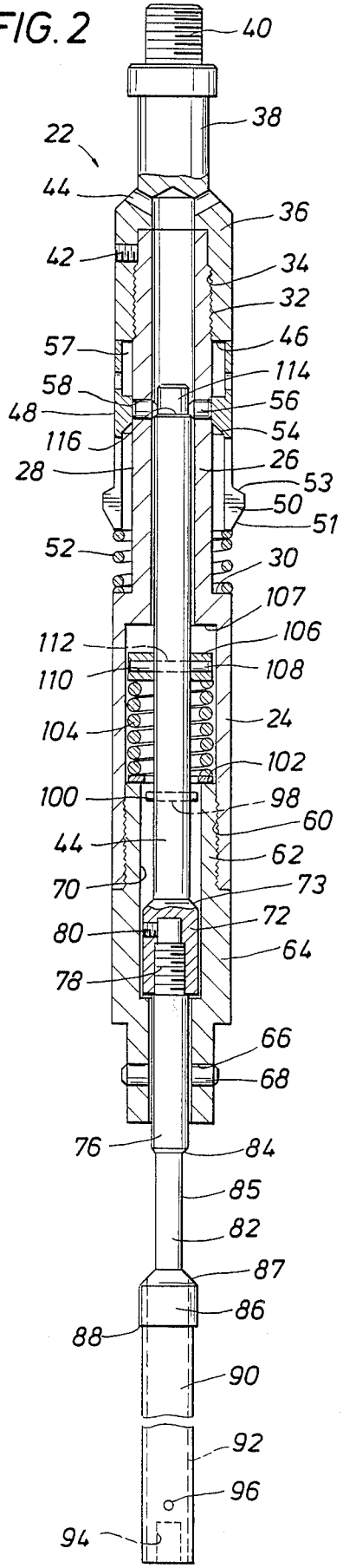
Figure 3:
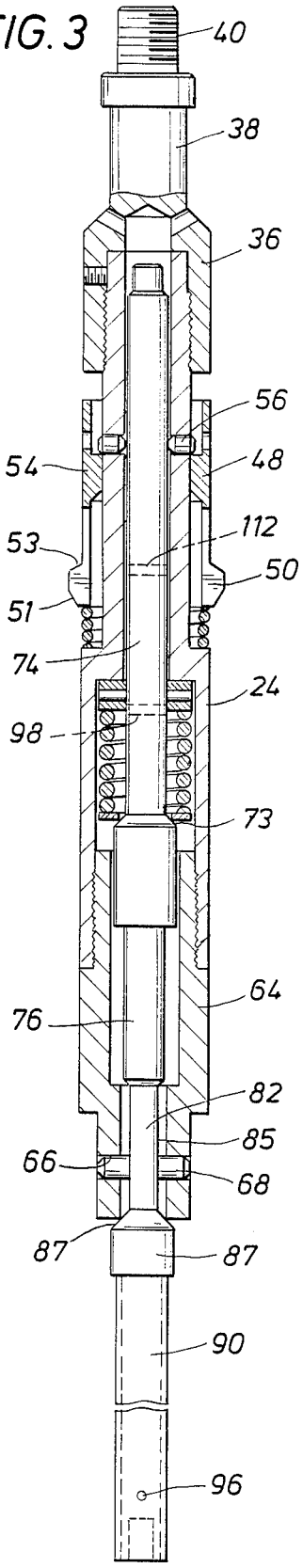

With reference now to FIGS. 2 and 3 a selective running tool constructed in accordance with the present invention is illustrated generally at 22 and includes a central tubular housing 24 having an upper extension 26 forming a reduced diameter outer surface 28. The surface 28 forms a spring stop shoulder 30 at its juncture with the larger diameter portion of the housing 24. The upper extension 26 is provided with an externally threaded section 32 adapted to receive the internal threads 34 of an upper tool string connection sub 36. The sub 36 forms an upwardly extending fishing neck 38 having an externally threaded tool string connection 40 enabling the running tool to be securely connected to any suitable tool positioning string such as wireline apparatus for example. The upper sub 36 is secured against rotation relative to the body extension 26 by means of a set screw 42. The sub 36 also forms washout ports 44 which permit efficient cleaning of the running tool. The sub 36 also forms a downwardly facing shoulder 46 which forms a stop for the upper extremity of a tubular collet member 48 having a plurality of collet fingers 50 extending downwardly therefrom. The collet fingers are disposed in engagement with the upper end of a compression spring 52 having its lower end seated against the spring stop shoulder 30. Intermediate the extremities of the collet 48 is provided an internal retainer flange 54 which is of cylindrical form and is disposed in close fitting, sliding relation with the cylindrical outer surface 28 of the extension 26. The collet forms wash-out ports 59 which permit cleaning of the lug recess 57 defined by the annulus between the extension 26 and the inner collet wall. The retainer flange 54, in the position shown in FIG. 2, restrains movement of locking lug members 56 which are movably retained within slots or apertures 58 formed in the housing extension 26. Operation and function of the locking lugs 56 will be discussed hereinbelow.

The housing 24 forms an internally threaded section 60 which receives an externally threaded section 62 of a lower tubular sub 64. Apertures or slots 66 are formed at the lower portion of sub 64 and receive locking lug members 68 which are adapted to be received within the fishing neck of a mandrel such as that set forth in FIG. 1. The lower sub forms an internal passage 70 of a dimension sufficiently large to receive the internally threaded connection member 72 of an upper core member or section 74. A lower core member or section 76 includes an upper threaded extension 78 which is received by the internally threaded connection 72 and is secured therein by means of a set screw 80. The connection 72 of the upper core section 74 forms a downwardly facing stop shoulder 75 which engages an internal stop surface 77 of the housing to limit downward telescoping movement of the elongated core. The lower core member defines a reduced diameter portion 82 forming a downwardly directed tapered shoulder 84. At its lower portion the lower core member includes an enlargement 86 forming a shoulder 88. The lower core member also includes a lower extension 90 capable of being received within a mandrel such as that shown at 18. This lower extension 90 defines fluid bypass flats 92 to permit circulation of fluids through the mandrel if desired. The lower extension 90 also forms an internally threaded receptacle 94 which is adapted to receive the equalizing prong of a tool support mandrel if such is provided. The extension 90 also forms a transverse bore 96 through which extends a shear pin to establish releasable connection with the opening 20 of the mandrel of FIG. 1.

The upper core member 74 forms a transverse bore 98 which receives an indicator shear pin 100 which may be formed of brass or any other suitable material. Shear pin 100 is provided for the purpose of indicating that the mandrel has been properly positioned and the locator dogs thereof have been shifted to the locked position. Thus, the condition of the mandrel is capable of being clearly ascertained upon disassembly of the running tool and verification that the indicator shear pin 100 has been sheared.

The lower sub 64 also forms an upwardly directed shoulder 102 which serves as a lower stop for a compression spring member 104. A shear pin ring 106 functions as an upper stop for the compression spring 104 and is secured to the upper core 74 by means of a shear pin 108 which extends through a transverse passage 110 of the shear pin ring and a transverse passage 112 of the upper core member.

At its upper end the upper section of the core defines a reduced diameter portion 114 which, at its juncture with the principal diameter of the core member, forms an upwardly directed tapered shoulder 116. The locking lugs 56 engage the shoulder 116 to restrain upward movement of the upper core 74 by the force of the compression spring 104 acting through shear pin ring 106. At its lower end the upper core section 74 forms a tapered shoulder 73 that is of sufficiently large diameter to contact the lower end of the compression spring 104. After the pin 108 has been sheared and the housing is collapsed telescopically over the mandrel immobilized core the shoulddr 73 will contact the lower end of spring 104 thus compressing the spring and using its spring force to cushion the last portion of the housing travel relative to the core. This feature protects the mandrel against excessive jarring shock as the housing reaches the downward limit of its travel.

OPERATION

The compression spring member 104 is placed under compression upon assembly of the threaded connection 60–62 thus developing an upwardly directed spring force acting against the shear pin ring 106. This force is resisted by the shear pin 108, thus causing the spring 104 to urge the core member 74 upwardly such that the shoulder 116 thereof is positively retained by the opposed lug members 56. Although only two lug members are shown it is to be understood that the extension 26 may incorporate a single lug member or a plurality of lug members as is appropriate for proper restraint of the core member 74. In this position the lugs 56 will be restrained in the extended positions thereof as shown in FIG. 2 by the retainer flange 54 of the collet member 48. Thus, the lugs are unable to move outwardly for release of the core member 74.

The mandrel, such as that shown at 18 in FIG. 1, is then interconnected with the lower core 82. This is done by extending the lower extension 90 of the core into the mandrel and positioning a shear pin within the aligned openings 20 and 96. The running tool is then secured to the tool string by threading the connector 40 into an appropriate internally threaded receptacle of the tool string. The running tool with the mandrel attached is then lowered into the well by wireline or by other suitable means and is passed through the desired landing nipple and moved to a level a few feet below the location of the landing nipple. During movement of the running tool through the mandrel the downwardly directed tapered surfaces of the collet fingers will engage the landing nipple thereby collapsing the collet fingers and permitting the collet to pass easily through the landing nipple. The collet will be restrained from upward movement by its contact with stop shoulder 46.

To locate the mandrel relative to the landing nipple the running tool and mandrel are then lifted upwardly through the landing nipple. As the collet 46 reaches the restriction of the landing nipple the upwardly directed shoulders 53 of the collet fingers will engage the landing nipple tending to shift the collet 48 downwardly against the compression of its spring 52. This downward movement of the collet causes the internal retainer flange 54 to clear the lug members 56. When this occurs the force developed by tapered shoulder 116 acting on the tapered inner end portions of the lugs will urge the lug members outwardly thereby releasing the upper core member for upward movement relative to the housing 24. In this position the lug members 56 will move into the recess 57 defined between the housing extension 26 and the upper end of the collet 48. Upward movement of the core 74 relative to the housing will be limited by contact of the shear pin ring 106 with the internal shoulder 107 of the housing. This movement, which may be in the order of one-half inch, will force the locating apparatus of the mandrel from its retracted position to the locating position. After this has been done the tool string is again lowered until the locating dogs on the mandrel locate inside the desired landing nipple and can no longer move down the well's tubing. At this point, with the shear pin ring in engagement with the shoulder surface 107 downward jarring action of the tool string will cause the shear pin 108 to shear, thereby releasing the shear pin ring 106 from the core 74. The core is thus permitted to move further upwardly relative to the housing without being influenced by the compression of spring 104 or retained in any other manner. Shearing of the pin 108 will allow the body of the running tool to slide downwardly over the interconnected core sections 74 and 76 thus shifting the fishing neck of the mandrel downwardly and forcing the locator dogs of the mandrel to the locked position thereof. This locked position of the mandrel will be positively identified by shearing of the indicator shear pin 100. As the core 74 is moved to its full extend within the housing 24 the indicator shear pin will contact and be sheared by the lower portion of the shear pin ring 106, thus providing an indication that the mandrel has been placed in its fully locked position.

With the mandrel in the locked position and with the cores 74 and 76 moved upwardly the recessed area 85 between the downwardly directed shoulder 84 and enlargement 86 will be positioned in registry with the openings 66. This will allow the locking lug members 68 to be shifted inwardly by tapered surfaces within the mandrel, thus releasing the fishing neck of the mandrel from the running tool. The shear pin 96 pinning the running tool to the mandrel is then sheared by an upwardly jarring activity, thereby completely releasing the running tool from the mandrel and leaving the mandrel securely locked in the desired landing nipple. The tool string and running tool are then retrieved from the well. The threaded connection 60–62 is then unthreaded to separate the lower sub 64 from the housing and allow the core to be removed from the housing. After the running tool has been cleaned and the locking lugs 56 have been shifted in openings 58 to the position shown in FIG. 2 the collet is then shifted to the position shown in FIG. 2. The running tool can then be reassembled as set forth below with new shear pins installed to thus ready it for future use.

ASSEMBLY

The running tool apparatus is capable of being easily and simply disassembled even under field conditions and thus it can be used repeatedly on-site. To ready the running tool apparatus for use the housing 24 is secured such as by means of a vise with the externally threaded connection 32 facing upwardly. The spring member 52 is then positioned about the reduced diameter extension 26 after which the lug members 56 are positioned within their respective slots or openings. The collet member 4B is then positioned about the extension 26. The collet is moved to position shown in FIG. 2 by threading of the upper sub 36 onto the threaded upper section 32 of the extension. This activity will induce compression of the spring 52, causing the spring to urge the collet into seated relation against the shoulder 46 of the upper sub. The set screw 42 will then be tightened to positively secure the upper sub in assembly with the housing 24.

The lower section of the running tool is assembled by securing the lower core member 76 such as by means of a vise with the externally threaded connection 78 directed upwardly. The lower lug members 68 are then installed within the slots 66 by installing them from the inside of the bottom sub 64. The bottom sub with the lugs 21 installed is than placed over the threaded connection 78 and slipped downwardly to engage the tapered shoulder 87 of the enlargement 86. The upper core member 74 is then placed in threaded connection with the upper threaded end 78 of the lower core and is tightened and secured by means of the set screw 80. An indicator shear pin 100 is then installed in the transverse passage 98 of the upper core 74. It should be borne in mind that the shear pin 100 will only be sheared if the mandrel has been properly locked in a landing nipple. Thus, the shear pin 100 is provided only for purposes of positively indicating the condition of the mandrel after retrieval of the running tool from the well.

Compression spring 104 is then placed about the upper core 74 and positioned in engagement with the internal shoulder 102 of the lower sub 64. The shear pin ring 106 is then positioned about the core with its passage 110 in registry with the transverse passage 112 and the shear pin 108 is extended through the aligned passages thus positively securing the shear pin ring to the core.

The lower section of the running tool is then connected to the mandrel (a locking device used to secure a storm choke, safety valve, plug, etc. as it is being located in the well.) This is accomplished by sliding the lower extension 90 of the lower core into the mandrel until shoulder 88 engages an appropriate shoulder provided on the inside of the mandrel. In this position the transverse passage or bore 96 of the lower connecting section is in alignment with the shear pin passage 20 of the mandrel. A shear pin is placed within the aligned passages thus positively securing the mandrel to the running tool. The lower core of the running tool defines an internally threaded receptacle 94 which is available in the event an equalizing prong is required. With the running tool collapsed as shown in FIG. 3 and the lower sub 64 positioned in assembly with the fishing neck of the mandrel, the fishing neck 38 is lifted thus moving the housing upward relative to the core formed by core sections 74 and 76. The lugs 68 are forced outwardly by tapered shoulder 84 and thus securely locked inside the fishing neck of the mandrel as the larger diameter portion of the lower core 76 become positioned between the locking lugs 68 as shown in FIG. 2. The locking lugs 68 will subsequently release their locked interconnection with the mandrel only when the tool is collapsed by downward jarring to shear pin 108 to allow the small diameter section 85 of core section 76 to receive the lugs as shown in FIG. 3, In view of the foregoing it apparent that the present invention is adapted to attain all of the objects and features herein set forth together with other features that are inherent from the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit and scope thereof, it is to be understood that all matters hereinabove set forth or shown in the accompanying drawings are to be interpreted as illustrative and not in any limiting sense.

What is claimed is:

1. A downhole running tool for positioning and locking tool support mandrels within landing nipples of thin production tubing string of a well, comprising:

(a) housing means adapted for connection to a tool string and forming an internal receptacle;

(b) an elongated core member being disposed within said internal receptacle and being telescopically movable to collapsed and extended positions defined by spaced stops formed by said housing means, a portion of said elongated core member extending from said housing for connection with a tool support mandrel;

(c) releasable retainer means normally retaining said elongated core member at a substantially fixed set position within said internal receptacle and being released responsive to engagement with said landing nipple during upward movement of said downhole running tool to thus permit collapsing telescoping movement of said elongated core to a mandrel locating position within said internal receptacle, said releasable retainer means comprising:

(1) locking lug means being movably retained by said housing means and being movable between core restraint and core release positions, in said core restraint position said locking lug means restraining telescopically collapsing movement of said elongated core member within said internal receptacle;

(2) a collet member being linearly movable relative to said housing and forming a plurality of collet fingers, said collet member being normally located at a locking position securing said locking lug means at said core restraint position and being linearly movable to a lug release position by collet restraining engagement of said collet fingers with said landing nipple during upward movement of said downhole running tool through said landing nipple;

(3) means urging said collet member toward said locking position;

(d) means urging said elongated core member toward said telescopically collapsed position thereof; and (e) means responsive to downward jarring of said housing means against said elongated core member for releasing said elongated core member for linear movement to its fully telescopically collapsed position within said internal receptacle.

2. A downhole running tool as recited in claim 1, wherein:

(a) said housing means forms internal stop means limiting downward movement of said elongated core member within said internal receptacle; and (b) said elongated core member forms a downwardly directed stop shoulder that engages said internal stop means at the downward limit of core movement within said internal receptacle.

3. A downhole running tool as recited in claim 2, wherein:

(a) said elongated core member defines upper and lower core sections; and (b) a core coupling establishes interconnection of said upper and lower core sections, said core coupling forming said downwardly directed stop shoulder.

4. A downhole running tool as recited in claim 1, wherein said collet member forms a lug recess and a lug restraining shoulder, upon downward movement of said collet member relative to said housing means said lug restraining shoulder moving clear of said locking lug means and said lug recess moving into registry with said locking lug means thus permitting movement of said locking lug means to said core release position.

5. A downhole running tool as recited in claim 4, wherein said elongated core member defines a locking shoulder that is engaged by said locking lug means at said core restraint position.

6. A downhole running tool as recited in claim 5, wherein:

(a) said locking lug means forms a tapered locking surface; and (b) said locking shoulder of said elongated core member is of tapered configuration and reacts with said tapered locking surface of said locking lug means to impart retracting movement of said locking lug means to said core release position.

7. A downhole running tool as recited in claim 1, wherein said means responsive to downward jarring of said housing means comprises a core restraining shear pin extending through said elongated core member and being sheared by force of said housing means as said housing means is moved downwardly.

8. A downhole running tool as recited in claim 1, wherein said means responsive to downward jarring of said housing means comprises:

(a) a shear pin ring being disposed about said elongated core member and forming a first passage;

(b) said elongated core member forming a second passage and aligned with said first passage;

(c) a shear pin being positioned within said aligned first and second passages; and (d) a compression spring being seated within said internal receptacle and applying an urging force against said shear pin ring for urging said elongated core member toward said telescopically collapsed position.

9. A downhole running tool as recited in claim 8, wherein a second shear pin is positioned within said elongated core member and is sheared upon movement of said elongated core member to a position locking said mandrel to said landing nipple and releasing said housing means from said mandrel to provide visual indication of locking of said mandrel to said landing nipple.

10. A downhole running tool as recited in claim 9, wherein:

(a) second lug means is movably supported by said housing means and is movable from a locking position establishing locking engagement with the fishing neck of said mandrel to a mandrel release position releasing locking engagement thereof from said fishing neck of said mandrel; and (b) said elongated core member at said extended position retaining said second lug means at said locking position and forming a lug recess section which is in registry with said second lug means at the fully telescopically collapsed position of said elongated core member thus permitting movement of said second lug means to said mandrel release position.

11. A downhole running tool as recited in claim 10, wherein:

(a) said elongated core member defines a mandrel connector extension that is received within said mandrel and forms a shear pin passage; and (b) a mandrel shear pin interconnects said mandrel connector extension with said mandrel and is sheared by upward jarring movement of said downhole running tool to release said elongated core member from said mandrel.

12. A downhole running tool for positioning and locking tool support mandrels having fishing necks and locking mechanisms within landing nipples of thin production tubing string of a well, comprising:

(a) an elongated housing adapted at its upper extremity for connection to a tool string and forming an internal receptacle, said elongated housing forming an external reduced diameter collet retainer section having lug slots formed therein, said housing further defining an internal upwardly directed stop shoulder;

(b) an elongated core member being disposed within said internal receptacle and being telescopically movable to collapsed and extended positions within said internal receptacle, a portion of said elongated core member extending from said housing and defining a mandrel connector extension being receivable in assembly with a mandrel and being connectable with the locking mechanism of said mandrel;

(c) upper and lower locking lug means being supported by said housing and being linearly movable between locking and release positions, said upper locking lug means in the locked position thereof having restraining engagement with said elongated core member to restrain said elongated core member against telescopically collapsing movement within said internal receptacle, said lower locking lug means, in the lock position thereof, establishing locking engagement with the fishing neck of said mandrel;

(d) an external collet member being received by said reduced diameter collet section of said housing and being linearly movable from a locking position retaining said upper lug means at said locking position thereof for restraining movement of said core within said internal receptacle and a lug releasing position upon upward movement of said downhole running tool through said landing nipple permitting movement of said upper lug means to said release position thereof by said elongated core member, said collet member forming a plurality of collet fingers each forming upwardly and downwardly tapered surfaces for engagement with internal surfaces of said landing nipple;

(e) means urging said collet member toward said lug locking position thereof;

(f) means urging said elongated core member toward said telescopically collapsed position thereof; and (g) means responsive to downward jarring of said housing against said elongated core member for releasing said elongated core member for linear movement to its fully telescopically collapsed position within said internal receptacle.

13. A downhole running tool as recited in claim 12, wherein said elongated core member forms a section restraining movement of said second lug means to said mandrel release position prior to linear movement of said elongated core member to said fully telescopically collapsed position, said elongated core member forming lug recess means for receiving said second lug means and thus permitting movement of said second lug means from said mandrel locking position to said mandrel release position.

14. A downhole running tool as recited in claim 12, wherein:

(a) said elongated core member defines upper and lower core sections; and (b) a core coupling establishes interconnection of said upper and lower core sections, said core coupling forming a downwardly directed stop shoulder engageable with said upwardly directed stop shoulder to limit telescopic extension movement of said elongated core member within said internal receptacle.

15. A downhole running tool as recited in claim 12, wherein:

(a) said housing defines a downwardly directed internal stop shoulder; and (b) a shear pin is extended through said elongated core member and is sheared responsive to downward jarring of said downwardly directed stop shoulder with said elongated core member restrained against downward movement by said mandrel.

16. A downhole running tool as recited in claim 15, wherein:

(a) a shear pin ring is disposed within said internal receptacle and surrounds said elongated core member, said shear pin ring forming a passage receiving said shear pin; and (b) a compression spring is located within said internal receptacle and applies an upwardly directed spring force against said shear pin ring, thereby urging said elongated core member toward said telescopically collapsed position thereof.

17. A downhole running tool as recited in claim 16, including a second shear pin being positioned within said elongated core member and being sheared upon movement of said elongated core member to the fully telescopically collapsed position thereof for locking of said mandrel to said landing nipple and releasing said housing from said mandrel to provide visual indication of locking of said mandrel within said landing nipple.

18. A downhole running tool as recited in claim 12, wherein said urging means provides cushioning between said elongated housing and said elongated core member during the last portion of the telescopically collapsing movement of said elongated housing relative to said elongated core member.

* * * * *